United States Patent [19]

Eblen et al.

[11] 4,356,976

[45] Nov. 2, 1982

[54] FUEL INJECTION NOZZLE FOR INTERNAL COMBUSTION ENGINES

[75] Inventors: Ewald Eblen; Odon Kopse, both of Stuttgart, Fed. Rep. of Germany

[73] Assignee: Robert Bosch GmbH, Stuttgart, Fed. Rep. of Germany

[21] Appl. No.: 201,636

[22] Filed: Oct. 28, 1980

[30] Foreign Application Priority Data

Oct. 31, 1979 [DE] Fed. Rep. of Germany ..... 2943896

[51] Int. Cl.[3] ..... F02M 45/08

[52] U.S. Cl. ..... 239/533.5; 239/447

[58] Field of Search ..... 239/533.2–533.12, 239/444, 446, 447; 123/294, 299, 303

[56] References Cited

U.S. PATENT DOCUMENTS 2,727,498 12/1955 Reiners ..... 239/533.5 X 3,802,626 4/1974 Regneault et al. ..... 239/533.5 X

FOREIGN PATENT DOCUMENTS 2513588 3/1975 Fed. Rep. of Germany ... 239/533.5

1544507 3/1976 United Kingdom ..... 239/533.5

*Primary Examiner*—John J. Love

*Assistant Examiner*—Gene A. Church

*Attorney, Agent, or Firm*—Edwin E. Greigg

[57] ABSTRACT

A fuel injection nozzle is proposed having two nozzle needles in which the control of the fuel delivered via an inflow line is effected by means of a slide valve embodied as a 3-way valve, which in a preferred embodiment of the invention is simultaneously embodied as a 3-position valve and permits not only the alternative exertion of the fuel pressure upon one of the nozzle needles but also a common pressure exertion of both nozzle needles.

7 Claims, 5 Drawing Figures

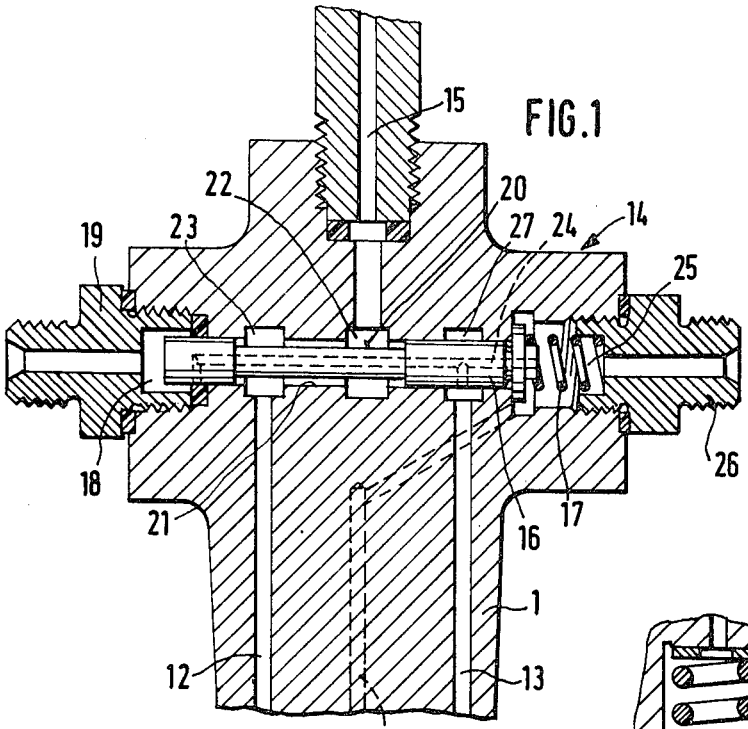
FIG.1
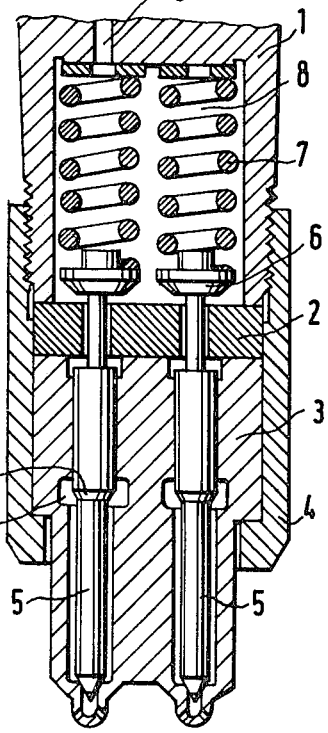
FIG.2
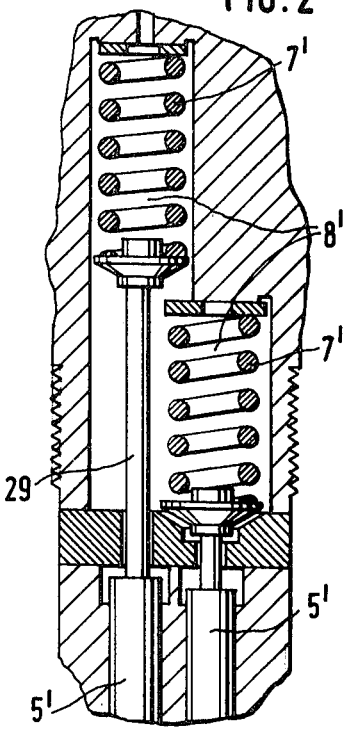

FUEL INJECTION NOZZLE FOR INTERNAL COMBUSTION ENGINES

BACKGROUND OF THE INVENTION

The invention relates to a fuel injection nozzle for an internal combustion engine. In a known fuel injection nozzle of this kind, the pressure chambers are supplied with fuel either by two pumps or from two independent work chambers, and it is possible to bring the second chamber into play via the slide valve only while the first chamber is supplying fuel. In other words, this is a specialized fuel injection system which is relatively expensive because of the requirement for two work chambers and furthermore has only a limited application.

OBJECT AND SUMMARY OF THE INVENTION

The fuel injection pump according to the invention and having the characteristics set forth herein has the advantage over the prior art that the fuel injection nozzle can be supplied with fuel even with a conventional injection pump, such as a distributor pump, having only one pump work chamber. In addition, there is the possibility of the switching alternatively or switching over from one to the other, as well as of bringing the injection nozzles into play in common. Additional important embodiments of the invention are shown in the drawing and described below.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a cross-sectional view of the first exemplary embodiment in simplified form;

FIG. 2 is a cross-sectional detailed view of the exemplary embodiment shown in FIG. 1.

DESCRIPTION OF THE PREFERRED EMBODIMENTS

Figure 3:
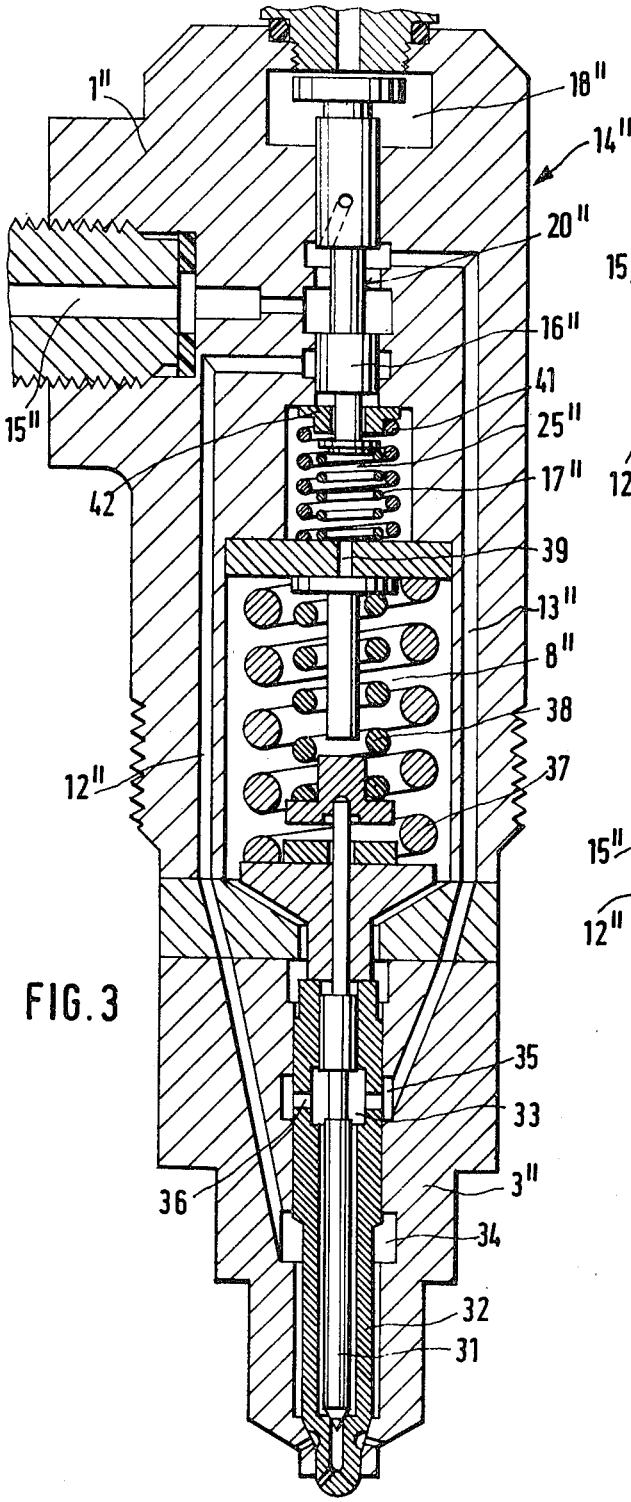
FIGS. 3, 4 and 5 also show further cross-sectional views of the second exemplary embodiment of this invention.

In FIG. 1, a fuel injection nozzle is shown having the conventional structure as follows: nozzle holder 1, intermediate plate 2, nozzle body 3, sleeve nut 4 and nozzle needles 5. The nozzle needles 5 are urged in the closing direction by closing springs 7 via spring supporting plates 6. The chamber 8 which encloses the springs 7 is relieved of pressure via a channel 9. The invention pertains to an injection nozzle having two nozzle needles 5 and, correspondingly, two closing springs 7, but only one spring chamber 8. Between the nozzle needles 5 and the nozzle body 3 there are pressure chambers 11 in the area of the pressure shoulder 10 of the nozzle needle 5. The pressure chambers 11 communicate with inlet channels 12 and 13 in the nozzle holder 1, the channels 12 and 13 being connectable via a slide valve 14 with an inlet line 15, by way of which the fuel, under high pressure, is delivered to the injection nozzle.

In FIG. 1, the upper portion of the nozzle holder 1 has been shown rotated by 90° relative to the lower portion, in order to be able to show one each of the pressure chambers 11 in the nozzle body 3 and the closing spring 7 in section and also to be able to show the inlet channels 12 and 13 in the upper portion. The slide valve 14 is provided with a slide 16, which is displaceable counter to the force of a restoring spring 17 by pressure fluid located in a chamber 18. The particular fluid is controlled in accordance with engine characteristics by means which are not shown (for instance, a magnetic valve) and is delivered to the chamber 18 via a nipple 19. Depending upon the pressure of this particular fluid, the slide 16 is displaced to a greater or lesser extent counter to the spring 17 and thus provides various connections between the inlet line 15 and the inlet channels 12 and 13. In the switching position shown, there is a connection from line 15 to channel 12. The fuel thus flows along an annular groove 20 of the slide 16 inside the bore 21 enclosing the slide 16, from an annular groove 22 of this bore 21 communicating with the inlet line 15 to an annular groove 23 communicating with the inlet channel 12. A relief channel 24 is disposed in the slide 16, which in the illustrated position is arranged to connect the inlet channel 13 with the pressure-relieved chamber 25 that encloses the spring 17. The relief line 9 of the spring chamber 8 also discharges into this chamber 25. The chamber 25 communicates with a leakage line, not shown, by means of a connector nipple 26.

As soon as the slide 16, as a result of increasing pressure in the pressure chamber 18, is displaced toward the right against the force of the spring 17, the annular grooves 22 and 23 communicate via the annular groove 20 with an annular groove 27, from which the inlet channel 13 branches off. After this distance has been covered, i.e., the slide 16 has moved to the right, as viewed in the drawing, the relief channel 24 can no longer communicate with the annular groove 27. This connection is effected in an intermediate position of the slide 16 and the precondition for it is that the annular groove 20 be longer than the distance from the annular groove 23 to the annular groove 27. In this position, both pressure chambers 11 are supplied with fuel, if such a supply is desired and if a pressure step is provided, such as that shown in FIG. 3. In the illustrated example, the slide 16 moves beyond this position until it is displaced against the nipple 26, which here acts as a stop. In this terminal position, the annular groove 20 is separated from the annular groove 23, so that only the connection between annular groove 22 and annular groove 27 remains. The fuel thus moves only into the inlet channel 13. The inlet channel 12 is blocked, and in this position it is relieved of pressure via the relief channel 24 in the slide 16.

In some internal combustion engines, there is only a small space for receiving the fuel injection nozzle, this being a bore of small diameter. When fuel injection nozzles having two parallel nozzle needles are used, it is accordingly necessary to dispose these needles are close as possible to one another, as indicated in FIG. 2. However, when there are parallel closing springs, this minimum distance is determined by the diameter of these springs, which cannot be further reduced as required. In the variant of the first exemplary embodiment shown in FIG. 2, in which the corresponding reference numerals are simply given a prime, the first spring 7′ is shifted relative to the other, so that only one lengthened pressure rod 29 of one nozzle needle 5′ extends beside the remaining spring 7′. The spring chamber 8′ is accordingly embodied in a stepped fashion.

Figure 4:
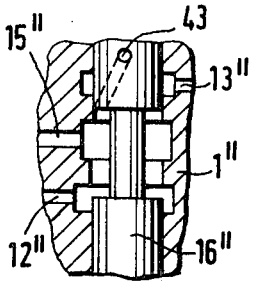
Figure 5:
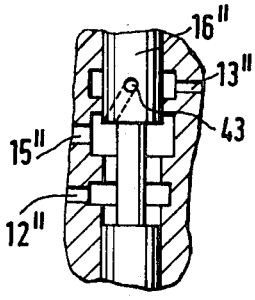

In the second exemplary embodiment shown in FIGS. 3–5, the reference numerals of elements corresponding to those of FIGS. 1 and 2 are given a double prime. As shown in FIG. 3, the two nozzle needles in this exemplary embodiment are disposed coaxially relative to one another, the first nozzle needle 31 being enclosed by a hollow needle 32. The nozzle needle 31 has a pressure chamber 33 disposed between the two needles, and the hollow needle 32 has a pressure chamber 34 disposed between the hollow needle 32 and the nozzle body 3″. While the pressure chamber 34 communicates directly with the inlet channel 12″, the connection between the inlet channel 13″ and the pressure chamber 33 is provided by an annular groove 35 disposed in the nozzle body 3″ and by radial bores 36 disposed in the hollow needle 32, which connect the annular groove 35 with the pressure chamber 33. The pressure springs acting upon the nozzle needles 31 and 32 are switched in parallel, as in the first exemplary embodiment. The closing spring 37 of the hollow needle 32 has a substantially larger diameter than does the closing spring 38 of the inner needle 31, because the face of the hollow needle 32 which moves in the opening direction under the impact of the delivered fuel is by its structure necessarily substantially greater in area than that of the inner needle 31. The pressure chambers 33 and 34 are hydraulically completely separated from the inlet channels 12″ and 13″ respectively. The slide-valve 14″ functions in principle and is similar to that shown in the first exemplary embodiment. In contrast thereto, however, the slide 16″ is disposed coaxially with the axis of the injection nozzle, because the fuel pressure connection with the fuel inlet line 15″ is effected transversely to the nozzle axis. Not only is there the advantage of the small diameter of this exemplary embodiment, but also fewer channels are necessary for preventing leakage, because the chamber 25″ enclosing the spring 17″ of the slide 16″ communicates directly with the spring chamber 8″ via a bore 39. In contrast to the first exemplary embodiment, the slide 16″, after covering a first stroke distance, strikes against a stop 42 which is subject to the force of a spring 41. Only when there is a further pressure increase (pressure step) in chamber 18″ is the force of the spring 41 overcome and the slide 16″ now displaced into its terminal position counter to the force of both springs 17″ and 41.

In the outset position of the slide 16″ shown in FIG. 3, the slide 16″ connects the inlet line 15″ with the inlet channel 13″ via the annular groove 20″. As soon as the slide 16″ is then displaced downward, counter to the force of the spring 17″, a connection is provided between the line 15″ and the channel 12″ after the distance to the stop 42 has been covered, so that fuel can be injected only via the hollow needle 32. The channel 13″ is then separated from the line 15″, as shown in FIG. 4. In FIG. 5, the slide 16″ is then shown in its terminal position, after the force of the spring 41 has been overcome. In this position, the line 15″ communicates with both channels 12″ and 13″. The connection with channel 13″ is effected by way of a bore 43 extending within the slide 16″. As a result, it is possible subsequently to open in sequence first one of the channels, then the other in alternation, and finally both at the same time.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising a nozzle body including a fuel inlet line and having two nozzle needles disposed longitudinally in said nozzle body and thereby arranged to control fuel flow from the inlet line to at least one injection port, each of said nozzle needles having pressure shoulders thereon, a pressure chamber disposed in said nozzle body in the region of said pressure shoulders and further including a separate inlet channel communicating with each of said pressure chambers, at least one of which is arranged to communicate with said fuel inlet line via a slide valve means as needed, characterized in that said slide valve means is embodied as a 3-way valve provided with a slide, by means of which said fuel inlet line can be made to communicate with at least one of said separate inlet channels to said pressure chambers in said nozzle body.

2. A fuel injection nozzle as defined by claim 1, characterized in that one of said inlet channels when separated from the inlet line can be relieved of pressure via said slide toward a chamber of lower pressure.

3. A fuel injection nozzle as defined by claim 1, characterized in that said slide is hydraulically actuated and arranged to strike a spring loaded stop which yields only after the increase of hydraulic pressure, so that the slide valve functions as a 3-position valve and said inlet line can also be made to communicate with both of said inlet channels.

4. A fuel injection nozzle as defined by claim 1, 2 or 3, characterized in that said slide valve has an axis which is disposed perpendicularly to the axis of the pressure connection of said nozzle.

5. A fuel injection nozzle as defined by claims 1, characterized in that said nozzle needles each cooperate with closing springs which are arranged to be switched in parallel to one another.

6. A fuel injection nozzle as defined by claim 5, characterized in that said nozzle needles are disposed in parallel relations relative to one another in a spring chamber said chamber enclosing a pair of springs, said springs being positioned in offset axial relation force of said nozzle needles being correspondingly lengthened.

7. A fuel injection nozzle as defined by claim 1, characterized in that said nozzle needles are disposed coaxially relative to one another, and further wherein one of said needles is embodied as a hollow needle and encloses said second needle.

* * * * *